US005962199A

United States Patent [19]

Moriya

[11] Patent Number: 5,962,199

[45] Date of Patent: Oct. 5, 1999

[54] PHOTOGRAPHIC IMAGE FORMING PROCESS

[75] Inventor: Tomonobu Moriya, Hino, Japan

[73] Assignee: Konica Corporation, Japan

[21] Appl. No.: 09/021,901

[22] Filed: Feb. 11, 1998

[30] Foreign Application Priority Data

Feb. 17, 1997 [JP] Japan ..... 9-031940

[51] Int. Cl.[6] ..... G03C 5/29

[52] U.S. Cl. ..... 430/435; 430/264; 430/436; 430/438; 430/440; 430/446

[58] Field of Search ..... 430/264, 435, 430/436, 438, 440, 446

[56] References Cited

U.S. PATENT DOCUMENTS 5,382,507 1/1995 Shimizu et al. ..... 430/435

5,405,732 4/1995 Shimizu et al. ..... 430/264

5,766,832 6/1998 Nishio ..... 430/483

*Primary Examiner*—Hoa Van Le

*Attorney, Agent, or Firm*—Jordan B. Bierman; Bierman, Muserlian and Lucas

[57] ABSTRACT

An image forming process of a silver halide photographic material comprising a glass support having thereon a silver halide emulsion layer is disclosed, the process comprising exposing with laser beam spot with a diameter of 0.05 to 5 μm and developing the exposed photographic material with a developer, wherein the silver halide emulsion layer contains silver halide grains having an average grain size of 0.08 to 0.2 μm and a chloride content of at least 50 mol %; the developer containing a developing agent selected from hydroquinone and ascorbic acid, and a developing agent selected from p-methyl-aminophenol, 1-phenyl-3-pyrazolidone and 1-pheny-4-dimethyl-3-pyrazolidone; and the developed photographic material having a contrast of 4.8 to 12.

4 Claims, No Drawings

PHOTOGRAPHIC IMAGE FORMING PROCESS

FIELD OF THE INVENTION

The present invention relates to an image forming process by the use of a silver halide light sensitive photographic material containing a silver halide emulsion layer and for use in a photomask, and in particular to a process for forming a photographic image with superior line sharpness and processing stability, containing little black foreign material and having superior adhesiveness of the emulsion layer to a support.

BACKGROUND OF THE INVENTION

Currently, to form a photo-mask for preparing a lead frame or an encoder, silver halide light sensitive photographic materials are subjected to exposure, with a plotter using a laser light source, and processed. Pattern images of the mask have become finer over the years and along therewith, the diameter of the laser light spot has also become smaller, and thereby image exposure is performed with rapid scanning. A decrease of the diameter of a laser light beam results in increased convergence of the laser so that the photographic material is exposed to laser with higher intensity and for a shorter period of time. As a result, deterioration of image sharpness, due to light scattering on the surface of the photographic material, becomes serious along with the increase of finer patterns. With regard to photographic materials, therefore, a technique is desired, in which fine patterns can be sharply reproduced even when subjected to high intensity, short-time exposure, such as laser exposure.

Glass dry plates for use in laser exposure have been conventionally processed mainly with a lith developer containing only hydroquinone as a developing agent. An advantage of the use of the lith developer is that edges of a line image are sharp and an image with ultra-high contrast can be obtained. On the other hand, the lith developer is notoriously unstable so that the level of the developer must be precisely controlled during processing. Thus, when a number of the dry plates are processed, there occur fluctuations of the line image width or the image density due to variation of developer stirring or developer activity. In light of the foregoing, a processing method is being studied, in which glass dry plates are processed with a rapid-access developer which is stable, compared to conventional lith developers and contains two or more developing agents.

When a dry plate which was conventionally processed with a lith developer was processed with the rapid-access developer, a number of fringes were disadvantageously produced at edge portions and superior images could not be obtained. To improve such defective image quality, JP-A 8-254796 discloses a technique of incorporating a hydrazine compound into a photographic material and JP-A 7-146523 discloses incorporation of a tetrazolium compound to obtain images with reduced fringes (herein, the term, "JP-A" means an unexamined and published Japanese Patent Application). The former is to accelerate development in the vicinity of images to obtain a high contrast image. In this case, however, the following defect was exhibited that, if a development center is present in an unexposed white background, it is developed to form a circular black spot, which becomes a foreign material in the mask. In the latter case, although no black foreign material is actually produced, there were defects exhibited such that the mask was discolored with by-products of the tetrazolium salt produced during development and was easily varied with preparation conditions, and further batch variation was large with respect to sensitivity.

SUMMARY OF THE INVENTION

It is an object to provide an image forming method, in which a sharp mask pattern with a little fringe and a high density can be obtained even when exposed to laser with high convergence efficiency and high intensity, and images with high quality are obtained without producing varied line width of the mask pattern even after subjected to continuous processing.

The object described above can be accomplished by the following constituent:

an image forming process comprising the steps of:

subjecting a silver halide light sensitive photographic material to exposure with laser light beam spot with a diameter of 0.05 to 5 $\mu$m and developing the exposed photographic material with a developer, wherein the silver halide light sensitive photographic material comprises a support having thereon a silver halide emulsion layer containing silver halide grains having an average grain size of 0.08 to 0.2 $\mu$m and a chloride content of at least 50 mol %; the developer containing a developing agent selected from the group consisting of hydroquinone and ascorbic acid, and a developing agent selected from the the group consisting of p-methyl-aminophenol, 1-phenyl-3-pyrazolidone and 1-pheny-4-dimethyl-3-pyrazolidone; and the developed photographic material having a contrast of 4.8 to 12.

DETAILED DESCRIPTION OF THE INVENTION

The laser light used in the invention has preferably wavelengths of 420 to 550 nm, including gas laser, semiconductor laser and YAG laser. Of the gas laser, Ar laser, He-Cd laser and He-Ne laser are preferred in terms of the wavelength. The diameter of the beam spot, which can be expressed in a half band width of emission intensity, is preferably 0.5 to 5 $\mu$m and more preferably 0.5 to 3.0 $\mu$m. When the beam diameter is too large, it is unsuitable for reproducing fine patterns, and when it is too small, it needs a long time for exposure.

Silver halide grains used in the invention contain at least 50 mol % chloride, based on silver, and examples thereof include silver chloride, silver bromochloride and silver iodobromochloride. Of these preferred are silver chloride and silver bromochloride. The average grain size is preferably 0.08 to 0.2 mm and more preferably 0.1 to 0.18 $\mu$m.

The size of silver halide grains can be determined by scanning type or transmission type electron microscopic observation of at least 30 grains. In the case of hexagonal grains, the grain size is measured as the edge length of a square, or the average of the long edge and short edge. In the case of spherical grains, the grain size is its diameter.

The silver halide grains used in the invention preferably contain at least a metal selected from Rh, Ru, Re and Os and a metal salt of Ir, respectively in an amount of $1\times10^{-8}$ to $5\times10^{-6}$ mol per mol of silver. Salts of these metals are added during the formation of the silver halide emulsion so that the metal is occluded into the grain. The metal salt may be added at the time of emulsion ripening or preparation of the coating solution. The metal salt selected from Rh, Ru, Re and Os may be added singly or in combination thereof. The metal salt is generally added in the form of an aqueous soluble complex salt. The metal complex is preferably hexa-coordinated, and examples of ligands include a halogen atom, a cyano group, a cyan group, or a nitrocyl group. Alternatively, silver halide grains containing the metal described above may be added during preparation of the silver halide emulsion. An iridium salt may also be added, in a manner similar to the above, in the form of a Ir-complex salt or silver halide grains containing Ir; and examples of an iridium complex include hexachloroiridium, hexaamineiridium and hexacyanoiridium.

The silver halide photographic material relating to the invention comprises a support having thereon hydrophilic colloidal layers including a silver halide emulsion layer. The lower-most layer of the hydrophilic colloidal layers, which is provided on the support, preferably contains a silane coupling agent or a titanium coupling agent. The silane coupling agent usable in the invention is represented by the following formula (S)

Formula (S)

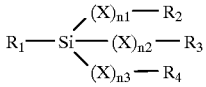

wherein X is an oxygen atom or —O—CO—; $R_1$, $R_2$, $R_3$ and $R_4$ are each a halogen atom or a hydrocarbon group which may be substituted, provided that at least one of $R_1$, $R_2$, $R_3$ and $R_4$ contains a double bond, a halogen atom, an epoxy group, an acid anhydride residue, an alkoxycarbonyl group or an amino group; n1, n2 and n3 are each 0 or 1, provided that all of n1, n2 and n3 are not 0 at the same time.

Examples of the halogen atom represented by $R_1$ to $R_4$ include fluorine, chlorine, bromine and iodine atoms. The hydrocarbon group include saturated or unsaturated, straight-chained or branched groups; and examples thereof include an alkyl group (e.g. methyl, ethyl propyl), an alkenyl group (e.g. vinyl, allyl) and an aryl group (e.g. phenyl, tolyl). Examples of the hydrocarbon group containing a double bond include an alkenyl group, an acryl group, methacryloyl group, vinylcarbonylamino group and isopropenylcarbonylamino group, while examples of a group containing an acid anhydride residue include methylcarbonyloxycarbonylethyl, and examples of a group containing a halogen atom include a haloacylamino group. Examples of the compound represented by formula (S) are shown below, but the invention is not limited to these examples.

(1)

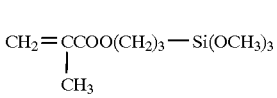

(2)

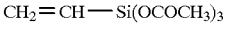

(3)

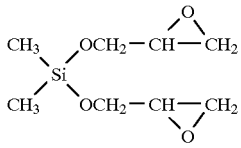

-continued (4)

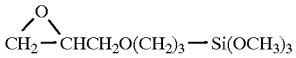

(5)

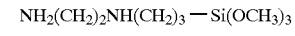

(6)

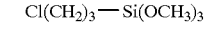

(7)

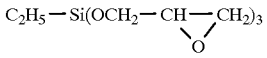

(8)

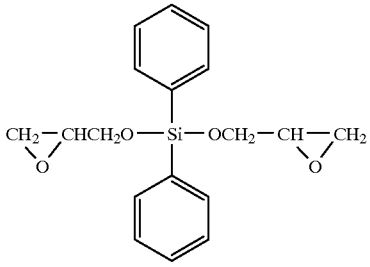

(9)

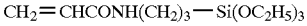

(10)

(11)

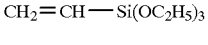

(12)

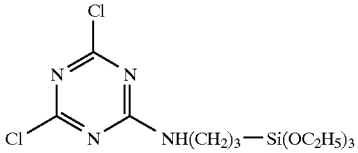

(13)

The compound represented by formula (S) can be synthesized according to the method described in JP-B 48-3565 (herein, the term, "JP-B" means an examined and published Japanese Patent) and are also commercially available from Toray Silicone Corp. or Chisso Corp. The silane coupling agent may be incorporated into a silver halide emulsion layer or an adjacent layer to the silver halide emulsion layer. The silane coupling agent is preferably incorporated through solution in a hydrophilic solvent, such as water, methanol or ethanol. The silane coupling agent is incorporated in an amount of 1 mg to 10 g and preferably 100 mg to 1 g per $m^2$. The silane coupling agent may be added at any time during the course of emulsion making and preferably at any time after completion of chemical ripening but before coating.

Examples of the titanium coupling agent usable in the invention are shown below, but the invention is not limited to these examples.

T-1

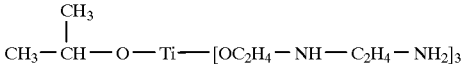

T-2

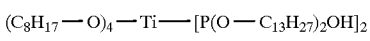

-continued

T-3

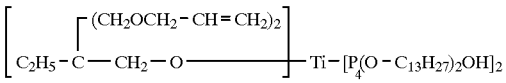

T-4

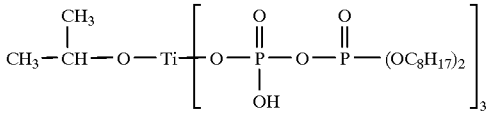

T-5

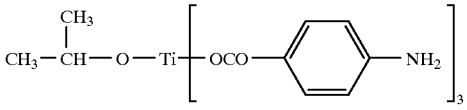

T-6

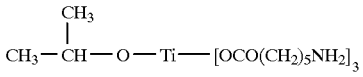

T-7

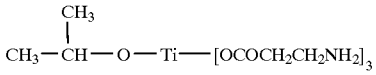

T-8

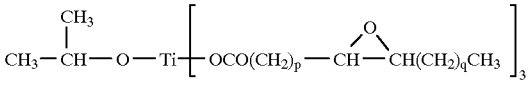

$6 \leqq p + q \leqq 18$

The titanium coupling agent may also be incorporated into a silver halide emulsion layer or a layer adjacent to the emulsion layer, in an amount of 1 to 500 mg/m$^2$, and preferably 10 to 100 mg/m$^2$.

A protective layer may be provided over the silver halide emulsion layer, as described in Japanese Patent Application No. 8-272340. The thickness of the protective layer is preferably 0.1 to 2 $\mu$m and more preferably 0.2 to 1.2 $\mu$m. The thickness of each layer of the photographic material can be determined by a sectional view of a scanning type electron micrograph.

The photographic material used in the invention preferably contains a hydrazine compound, and may further contain a nucleation accelerating compound or a redox compound. Exemplary examples of these compounds are described in JP-A 8-254796.

Specifically, hydrazine compounds represented by the following formula (1( are preferred:

Formula (1)

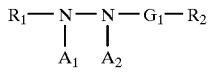

wherein $R_1$ represents an aliphatic group or an aromatic group; $G_1$ represents —CO—, —COCO—, —CS—, —C(=$NR_2$)—, —SO—, —$SO_2$— or —P(=O)($G_2R_2$)—, in which $G_2$ represents a bond, or —O—, —S— OR —N($R_2$)—; $R_2$ represents a hydrogen atom, an aliphatic group ot an aromatic group, provided that when plural $R_2$s are included in the molecule, they may be the same with or different from each other; one of $A_1$ and $A_2$ represents a hydrogen atom and the other thereof represents a hydrogen atom, a acyl group, an alkyl group or an arylsulfonyl group. Further, $R_1$ preferably has a substituent selected from —$(CH_2CH_2O)_N$—, —$[CH_2CH(CH_3)O]_N$— or —$[CH_2CH(OH)CH_2O]_N$—, or a quaternary ammonium cation, in which n is an integer of 1 or more. Exemplary examples of the hydrazine compounds are shown below, but the hydrazine compounds usable in the invention are by no means limited to these examples.

Hz-1

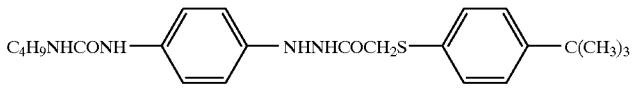

Hz-2

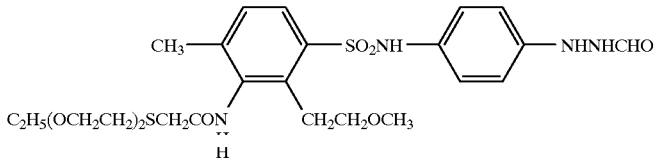

Hz-3

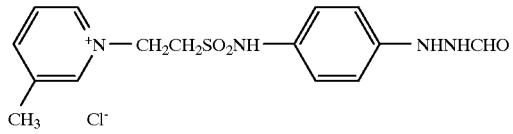

Hz-4

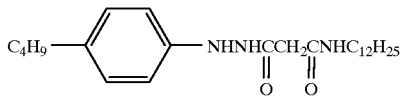

Hz-5

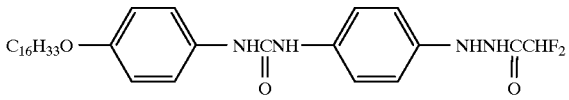

-continued

Hz-6

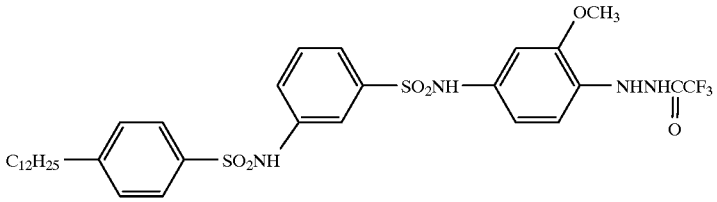

Hz-7

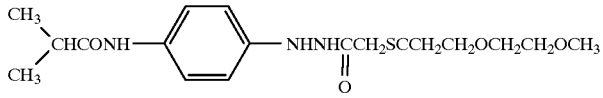

Hz-8

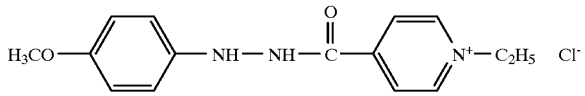

Hz-9

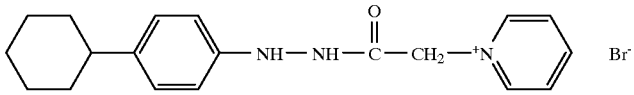

Hz-10

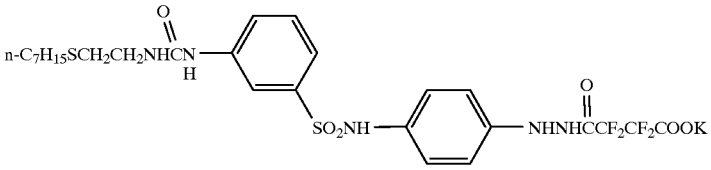

Hz-11

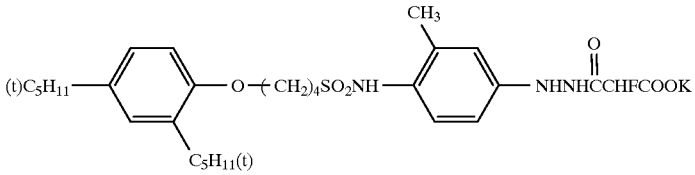

Hz-12

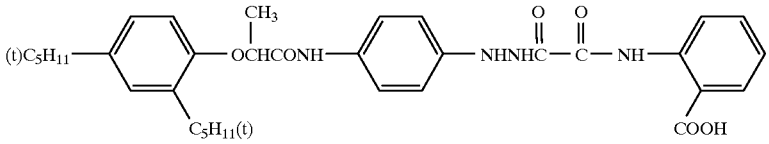

The hydrazine compound may be incorporated into a silver halide emulsion layer or a layer adjacent thereto (preferably, into the emulsion layer), in an amount of not more than $2\times10^{-4}$ and preferably not more than $1\times10^{-5}$ mol per mol of silver. Excessive amounts of the hydrazine compound are liable to produce black spots (so-called pepper fog) in non-imaging background. The black spots easily occur, specifically when developed with exhausted developer. In cases where the image contrast is too high by nucleation development, a line in the feeding direction and a line in the direction oblique to the axis become a notch-like form when imaging with rasterscanning of laser beam, and in particular, dimensional errors occur in the lines in the oblique direction. The contrast of the dry plate used in the invention is preferably from 4.8 to 12 and more preferably 5.1 to 9.7 between densities of 0.1 and 2.5. Herein the expression, contrast between densities of 0.1 and 2.5 means a slope of a straight line that connects two points corresponding to densities of 0.1 and 2.5 on a characteristic curve.

A glass support is preferably employed in the silver halide photographic material used in the invention. The glass support is not limited with respect to the glass composition, and soda-lime glass and soda-lime alumiglass. A float glass is also preferred in terms of surface flatness. The glass support may be previously treated with a silane coupling agent or a titanium coupling agent. The glass support may further be subjected to a degreasing treatment to enhance hydrophilicity of the glass surface. The glass support with ground edge faces is preferred in terms of handling.

A variety of techniques and additives known in the photographic art are applicable to silver halide emulsions used in the invention. A chemical sensitizer, a toning agent, a hardening agent, a surfactant, a thickening agent, a plasticizer, a lubricant, a development retarder, a UV absorbent, an anti-irradiation dye, a heavy metal or a matting agent may be incorporated into the silver halide emulsion layer or a backing layer. A polymer latex may be incorporated into the emulsion layer or a backing layer.

The additives are described in Research Disclosure vol. 176 item 17643 (December, 1978) and Research Disclosure vol. 187 item 18716 (November 1979), as summarized below.

| Additive | RD-17643 | RD-18716 |
|---|---|---|
| Chemical sensitizer | page 23 | page 648 right col. |
| Speed-increasing agent | | page 648 right col. |
| Sensitizing dye and supersensitizer | page 23–24 | page 648 right col.–page 649 right col. |
| Brightener | page 24 | |
| Antifoggant/stabilizer | page 24–25 | page 649 right col. |
| Light absorbent/filter dye/UV absorbent | page 25–26 | page 649 right col.–page 650 left col. |
| Antistaining agent | page 25 | page 650 left–right col. |
| Dye image stabilizer | page 25 | |
| Hardener | page 26 | page 651 left col. |
| Binder | page 26 | page 651 left col. |
| Plasticizer/lubricant | page 27 | page 650 right col. |
| Coating aid/surfactant | page 26–27 | page 650 right col. |
| Antistatic agent | page 27 | page 650 right col. |

The silver halide photographic material used in the invention can be developed with a developer containing a developing agent selected from metol (i.e. p-methylaminophenol, $HOC_6H_4CH_3.1/2H_2SO_4$), Phenidone (i.e. 1-phenyl-3-pyrazolidone) and Dimezone (i.e. 1-pheny-4-dimethyl-3-pyrazolidone) and a developing agent selected from hydroquinone and ascorbic acid. The developer described above is so-called rapid access PQ type or MQ type developer. The developer may contain a sulfite or a metabisulfite as a preservative, including sodium sulfite, potassium sulfite, ammonium sulfite and sodium metabisulfite. The sulfite is preferably contained in an amount of not less than 0.25 mol/l and more preferably not less than 0.4 mol/l. The developer may further contain an alkaline agent (e.g. sodium hydroxide, potassium hydroxide), an antisluging agent (e.g. compounds described in JP-B 62-4702, JP-A 3-51844, 4-26838, 4-362942 and 1-319031), a pH-buffer (e.g. carbonates, phosphates, borates, boric acid, acetic acid, acid, alkanol amine), a dissolution aid (e.g. polyethylene glycols and their esters, alkanol amines), a sensitizer (e.g. nonionic surfactant containing polyoxyethylene glycols, quaternary ammonium compounds), a surfactant, a defoaming agent, an antifoggant (e.g. halide such as potassium bromide or sodium bromide, nitrobenzindazole, nitrobenzimidazole, benzotriazole, benzothiazole, tetrazoles, thiazoles), a chelating agent (ethylendiaminetetraacetic acid and its alkaline metal salt, nitrilotriacetic acid, polyphosphonic acid), a development accelerator (e.g. compounds described in U.S. Pat. No. 2,304,025 and JP-B 47-45541), and a hardening agent (e.g. glutar aldehyde or its bisulfite adduct). The pH of the developer is preferably adjusted to less than 11.0, and more preferably 9.5 to 10.5.

One specific mode of development is that a developing agent is incorporated into a photographic material (e.g. into an emulsion layer) and the photographic material is treated with an activator solution which is an alkaline aqueous solution. In this case, development may be combined with a silver salt stabilizing treatment.

The developer may be in the form of a solid composition, an aqueous solution containing a glycol or an amine or a viscous liquid. These may be used in dilution or as they are.

Fixers conventionally used can be employed in the invention. Th e fixer contains a fixing agent and other adjuvants, having a pH of 3.8 to 5.8. Examples of the fixing agent include thiosulfates such as sodium thiosulfate, potassium thiosulfate and ammonium thiosulfate; and thiocyanates such as sodium thiocyanate, potassium thiocyanate and ammonium thiocyanate. An organic sulfur compound which is capable of forming an aqueous soluble, stable salt, can also be employed as a fixing agent. The fixer may contain, as a hardener, an aqueous soluble aluminum salt such as aluminum chloride, aluminum sulfate and potassium alum. The fixer may further contain a preservative (e.g. sulfites, bisulfites), a pH buffer (e.g. acetic acid), a pH adjusting agent (e.g. sulfuric acid) and a chelating agent capable of softening water.

The developed silver halide photographic material according to the invention has a contrast of not less than 4.8 and not more than 12. Herein, the contrast represents a slope of a straight line that connects two points corresponding densities of 0.1 and 2.5 on a characteristic curve. The densities and characteristic curve are determined by measuring the density of the photographic material after development processing including developing with a developer, for example, as described in the following Examples.

EXAMPLES

The present invention will be explained, based on examples but the invention is not limited to these examples.

Example 1

Preparation of Emulsion 1 (Em-1):

Solution A
Water 9.7 liter
Sodium chloride 20 g
Gelatin 105 g
Solution B
Water 94 g
Sodium chloride 363 g
Potassium bromide 452 g
Potassium hexachloroiridium (0.01% aqueous solution) 28 ml
Potassium hexachlororhodium (0.001% aqueous solution) 142 ml
Solution C
Water 3.8 liter
Silver nitrate 1700 g To solution A maintained at 40° C. were added solutions B and C at a accelerated rate over a period of 34 min., while the pH and pAg were kept at 3.0 and 7.6, respectively, and after stirring further for 10 min. and then adjusting the pH to 5.6 with a aqueous sodium carbonate solution, the emulsion was flocculated by adding 1.7 liters of an aqueous 20% magnesium sulfate solution and 2.55 liters of an aqueous 5% polynaphthalene sulfonate solution at 40° C. and decanted to remove excessive soluble salts. Then, water of 3.7 liters was added thereto to redisperse the emulsion, and 0.9 liters of an aqueous 20% magnesium sulfate solution was again added to remove soluble salts. Water of 3.7 liters and gelatin of 141 g were added to redisperse the emulsion at 55K C for 30 min. The resulting emulsion was comprised of silver bromochloride cubic grains containing 62 mol % chloride and having an average size of 0.18 $\mu$m and a coefficient of variation of grain size (in other word, monodispersity) of 9%.

Preparation of Emulsion 2 (Em-2):

Emulsion 2 was prepared in the same manner as in Emulsion 1, except that the addition time of solutions B and C were changed to 65 min. The resulting emulsion was comprised of silver bromochloride cubic grains containing 62 mol % chloride and having an average size of 0.26 $\mu$m and a coefficient of variation of grain size of 9%.

Preparation of Emulsion 3 (Em-3):

Emulsion 3 was prepared in the same manner as in Emulsion 1, except that sodium chloride and potassium bromide of solution B were changed to 175 g and 834 g, respectively. The resulting emulsion was comprised of silver bromochloride cubic grains containing 30 mol % chloride and having an average size of 0.18 μm and a coefficient of variation of grain size of 9%.

Preparation of Emulsion 4 (Em-4):

Emulsion 4 was prepared in the same manner as in Emulsion 1, except that potassium chloroiridium of solution B was removed. The resulting emulsion was comprised of silver bromochloride cubic grains containing 62 mol % chloride and having an average size of 0.18 μm and a coefficient of variation of grain size of 9%.

Preparation of Emulsion 5 (Em-5):

Emulsion 5 was prepared in the same manner as in Emulsion 1, except that potassium chlororhodium of solution B was removed. The resulting emulsion was comprised of silver bromochloride cubic grains containing 62 mol % chloride and having an average size of 0.18 μm and a coefficient of variation of grain size of 9%.

Emulsion ripening:

To each of emulsions 1 to 5 were added an aqueous 1% citric acid solution of 110 ml, an aqueous 5% sodium chloride solution of 110 ml, an aqueous 0.2% chloroauric acid solution of 18 ml and a 0.01% sulfur single body solution of 75 ml, and the emulsion was ripened at 60° C. for 60 min. After completion of ripening were further added 6-methyl-4-hydroxy-1,3,3a,7-tetraazaindene of 28 g and gelatin of 924 g.

Preparation of Emulsion Coating Solution:

To each of the ripened emulsions were added following compounds in an amount per mol of silver halide.

Sensitizing dye (D-1) 210 mg
Sensitizing dye (D-2) 135 mg
Hydrazine compound (Hz-1) as shown in Table 1
Nucleation accelerator (Na-1) as shown in Table 1
Redox compound (RE-1) as shown in Table 1
Dye (F-1) 920 mg
Compound (Z) 140 mg
Hydroquinone 5.4 g
Potassium bromide 570 mg
Polymer latex (E) 13 g
Surfactant (C) 70 mg
hardener (H) 550 mg
Silane coupling agent or
Titanium coupling agent as shown in Table 1

Sensitizing dye (D-1)

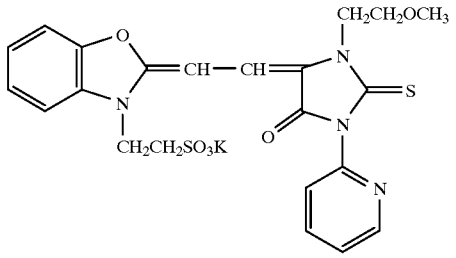

Sensitizing dye (D-2)

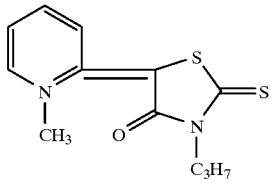

Hydrazine compound (Hz-1)

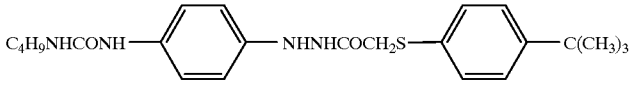

Nucleation accelerator (Na-1)

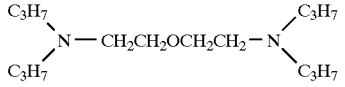

Redox compound (RE-1)

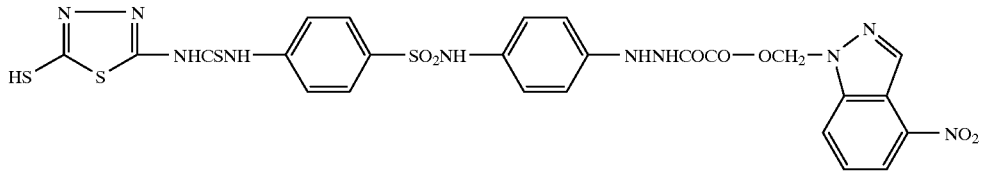

-continued

Dye (F-1)

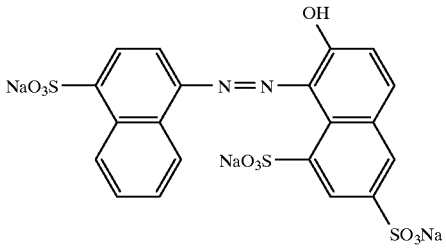

Compound (z)

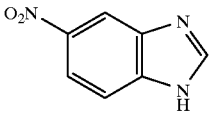

Latex (E)

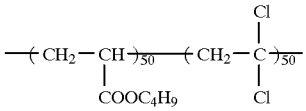

Surfactant (C)

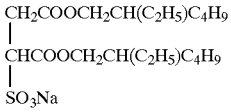

Hardener (H)

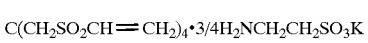

Preparation of Coating Solution of Protective Layer:

A solution having the following composition was prepared.

Gelatin 30 g
PMMA matting agent (Av. size 3 $\mu$m) 1.3 g
Surfactant (C) 0.2 g
Lubricant (L) 3.3 g
Hardener (H) 0.15 g
Water 800 ml Preparation of Coating Solution of Backing Layer:

A solution having the following composition was prepared.

Compound (P) 30 g
Dye (F-2) 5 g
Dye (F-3) 3 g
Dye (F-4) 3 g
Ethanol 450 ml
Methanol 450 ml Lubricant (L)

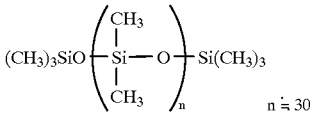

Compound (P)

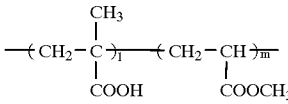

Dye (F-2)

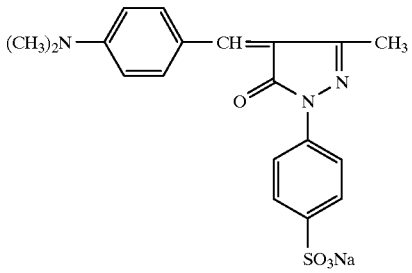

-continued

Dye (F-3)

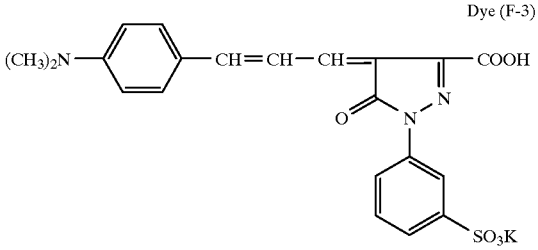

Dye (F-4)

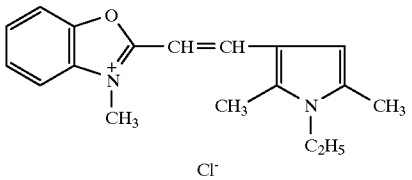

Preparation of Photographic Dry Plate:

(1) Coating of backing layer

On a glass support with a size of 24 inch×32 inch and a thickness of 5 mm was coating 8 cc of the coating solution described above, with a napkin coater to provide a backing (2) Coating of emulsion layer and protective layer On the other side of the support were simultaneously coated the coating solution of an emulsion layer and the coating solution of a protective layer so as to have a silver coverage of 4.1 g/m$^2$ and a gelatin coating amount of 0.5 g/m$^2$ (protective layer), using a curtain coater.

Thereafter, prepared photographic dry plates were each allowed to stand at 55° C. and 55% RH for 12 hr.

TABLE 1

| Sample | Emulsion | Hydrazine compd. (mg/Agmol) | Nucleation accelerator (mg/m$^2$) | Redox compd. (mg/m$^2$) | Copuling agent (mg/m$^2$) |
|---|---|---|---|---|---|
| 1 | Em-2 | — | — | — | S-4 (250) |
| 2 | Em-2 | — | — | — | — |
| 3 | Em-2 | $2 \times 10^{-4}$ | 30 | 10 | S-4 (250) |
| 4 | Em-3 | — | — | — | S-4 (250) |
| 5 | Em-4 | — | — | — | S-4 (250) |
| 6 | Em-5 | — | — | — | S-4 (250) |
| 7 | Em-1 | — | — | — | S-4 (250) |
| 8 | Em-1 | — | — | — | T-1 (15) |
| 9 | Em-1 | $2 \times 10^{-5}$ | 30 | 10 | T-1 (15) |
| 10 | Em-1 | $2 \times 10^{-5}$ | 30 | 10 | S-4 (250) |

Preparation of Developer:

A developer was prepare according to the following formula.

Deionized water 800 ml

Sodium ethylenediaminetetraacetate 2 g

Ethylene glycol 25 g

Potassium sulfite (55% solution) 60 ml

Potassium carbonate 15 g

Hydroquinone 20 g

5-Methylbenzotriazole 300 mg

1-Phenyl-5-mercaptotetrazole 60 mg

Potassium hydroxide 10.5 g

Potassium bromide 3.5 g

Dimezone (1-Phenyl-4,4-Dimethyl-3-pyrazolidone) 300 mg $CH_3—N(CH_3CH_2CH_2NHCONHCH_2CH_2SC_2H_5)_2$ 25 mg Water was added to make 1 liter of a developer working solution. The pH was adjusted to 10.8.

Evaluation of Photographic Dry Plate:

(a) Sensitometry

Each photographic dry plate sample was exposed, through a 488 nm filter and an optical wedge, to a xenon pulsar light source for $10^{-6}$ sec., then developed with the above-described developer at 25° C. for 2 min., followed by being fixed with a fixer (CFL-881, produced by Konica Corp.) at 25° C. for 3 min. Processed samples were each subjected to sensitometry. Densities and the characteristic curve are determined by measuring the the density. The contrast was determined between densities of 0.1 and 2.5 (γ), which was a slope of a straight line that connects two points corresponding to densities of 0.1 and 2.5 on the characteristic curve.

(b) Evaluation of image quality

A 20 μm encoder type black line image pattern was formed on each dry plate sample, by exposing it with a YAG laser plotter (CFL-881, produced by Dainihon Screen Corp.) having a beam spot of ϕ2 μm and a feeding pitch of 1 μm, and the exposed samples were developed with the above-described developer at 20° C. for 2 min., fixed in trays with the above-described fixer at 25° C. for 3 min. and subjected to washing and drying. The thus prepared masks were each evaluated with respect to the edge fringes and smoothness of oblique lines, based on 500 power microscopic observation. The less the fringe, the better; and the smoother the oblique line, the higher the smoothness.

(c) Line dimension precision

Each sample was exposed and processed in a manner similar to the evaluation of image quality described above, provided that each was exposed to laser light in an amount with the aim of obtaining a pattern line width of 20 μm. Dimensions of the width of a line in the scanning direction, of a line in the feeding direction and of an oblique line at an angle of 30° to the feeding direction were each measured, and the difference between the maximum value and the minimum value was determined for each sample. The less the difference, the higher the dimensional precision.

(d) Plate life

Processed plates were each brought into vacuum contact with a processed dry plate of a master mask over a period of 60 sec. in a vacuum contact apparatus using an evacuation pump. This procedure was repeated and the number of repeatition was noted until abrasion or peeling of the emulsion layer occurred. The higher the number, the better the plate life.

(e) Performance at exhaustion

Six plates of each sample, on which 20% of the total area was exposed, were developed with 1 liter of a developer. Using this exhausted developer, each dry plate sample was developed and evaluated in a manner similar to item (c). The number of black spots produced on unexposed portion was also counted.

Results thereof are shown in Table 2.

TABLE 2

| Sample No. | Contrast (γ) | Image quality | | Line dimension precision (μm) | | Number of black spot | Plate life | Remark |
|---|---|---|---|---|---|---|---|---|
| | | Fringe | Smoothness | Fresh | Exhausted | | | |
| 1 | 5.8 | 3.0 | 3.5 | 4.1 | 4.2 | 0 | 540 | Comp. |
| 2 | 5.8 | 3.0 | 3.5 | 4.1 | 4.2 | 0 | 20 | Comp. |
| 3 | 13.5 | 5.0 | 2.0 | 6.2 | 6.7 | 18 | 532 | Comp. |
| 4 | 4.6 | 3.0 | 3.5 | 3.8 | 3.8 | 0 | 548 | Comp. |
| 5 | 4.5 | 2.5 | 3.0 | 6.5 | 6.7 | 0 | 522 | Comp. |
| 6 | 4.0 | 1.5 | 2.0 | 7.5 | 8.3 | 0 | 512 | Comp. |
| 7 | 6.0 | 5.0 | 4.5 | 2.8 | 2.8 | 0 | 568 | Inv. |
| 8 | 6.0 | 5.0 | 4.5 | 2.8 | 2.8 | 0 | 511 | Inv. |
| 9 | 8.1 | 5.0 | 4.25 | 3.2 | 3.3 | 0 | 532 | Inv. |
| 10 | 8.1 | 5.0 | 4.25 | 3.2 | 3.2 | 1 | 524 | Inv. |

As can be seen from Table 2, it proved that invention samples 7 to 10 were superior in image quality, precision of the line width, plate life and performance at exhaustion, compared to comparative samples.

What is claimed is:

1. An image forming process comprising the steps of:

subjecting a silver halide light sensitive photographic material to exposure with laser light beam spot with a diameter of 0.05 to 5 μm and developing the exposed photographic material with a developer, wherein said silver halide photographic material comprises a glass support provided thereon with hydrophilic colloid layers including a silver halide emulsion layer, said silver halide emulsion layer containing silver halide grains having an average grain size of 0.08 to 0.2 μm and a chloride content of at least 50 mol %; the developer containing a developing agent selected from the group consisting of hydroquinone and ascorbic acid, and a developing agent selected from the the group consisting of p-methylaminophenol, 1-phenyl-3-pyrazolidone and 1-pheny-4-dimethyl-3-pyrazolidone; and the developed photographic material having a contrast of 4.8 to 12.

2. The image forming process of claim 1, wherein said silver halide grains contain a metal selected from the group consisting of rhodium, ruthenium, rhenium and osmium in an amount of $1\times10^{-8}$ to $5\times10^{-6}$ mol per mol of silver, and iridium in an amount of $1\times10^{-8}$ to $5\times10^{-6}$ mol per mol of silver.

3. The image forming process of claim 1, wherein said silver halide emulsion layer further contains a hydrazine compound in an amount of $1\times10^{-7}$ to $2\times10^{-4}$ mol per mol of silver.

4. The image forming process of claim 1, wherein the lower-most layer of the hydrophilic layers provided on the glass support contains a silane coupling agent or a titanium coupling agent.

* * * * *